United States Patent [19]

Johnson et al.

[11] Patent Number: 4,519,596

[45] Date of Patent: May 28, 1985

[54] METHOD AND APPARATUS FOR FOLDING DIAPERS WITH SELECTIVE MOVEMENT OF ORBIT OF TUCKER BALDE

[75] Inventors: Gary E. Johnson; Andrew M. Van Egeren, both of Green Bay, Wis.

[73] Assignee: Paper Converting Machine Company, Green Bay, Wis.

[21] Appl. No.: 630,647

[22] Filed: Jul. 13, 1984

[51] Int. Cl.[3] ..... B41L 43/00

[52] U.S. Cl. ..... 270/32; 493/12; 493/23; 493/416

[58] Field of Search ..... 270/32, 49–50; 493/12, 8, 13, 16, 23, 405, 413–414, 416–417, 419, 437, 454

[56] References Cited

U.S. PATENT DOCUMENTS

| | | | |
|---|---|---|---|
| 3,475,018 | 10/1969 | Mattra | 493/417 X |
| 3,692,303 | 9/1972 | Grantham | 493/23 |
| 4,053,150 | 10/1977 | Lane | 493/417 X |
| 4,238,060 | 12/1980 | Weir | 493/416 |
| 4,264,066 | 4/1981 | Meenen et al. | 493/12 |

FOREIGN PATENT DOCUMENTS

| | | | |
|---|---|---|---|
| 1216886 | 5/1966 | Fed. Rep. of Germany | 493/437 |
| 2232169 | 1/1973 | Fed. Rep. of Germany | 493/12 |
| 2436083 | 2/1976 | Fed. Rep. of Germany | 493/437 |
| 2504489 | 8/1976 | Fed. Rep. of Germany | 493/437 |

*Primary Examiner*—E. H. Eickholt

*Attorney, Agent, or Firm*—Tilton, Fallon, Lungmus & Chestnut

[57] ABSTRACT

A method and apparatus for transversely folding diapers which includes advancing a series of unfolded diapers along a horizontal path, orbiting a tucker blade for each diaper through said horizontal path to fold the diaper and deliver the now-folded diaper to a vertical path, and displacing the orbit of the tucker blade upwardly out of the horizontal path whenever a defective diaper appears in the series.

14 Claims, 4 Drawing Figures

METHOD AND APPARATUS FOR FOLDING DIAPERS WITH SELECTIVE MOVEMENT OF ORBIT OF TUCKER BALDE

BACKGROUND AND SUMMARY OF INVENTION

This invention relates to a method and apparatus for folding diapers and, more particularly, to the structure and operation of a crank actuated tucker blade for transversely folding diapers being advanced in a series.

Disposable diapers are currently made at high speed—from about 300 to about 400 units per minute on machines that bring together a moisture impervious web such as polyethylene, a fluff core and a web of nonwoven material providing the diaper surface next to the infant's body. A typical machine can be seen in U.S. Pat. No. 4,081,301. After the diapers have been formed and are being advanced in a continuous series or stream, there is a problem of maintaining the line at operating speed yet being able to sort out or cull imperfectly made diapers just ahead of the final folding operation before stacking and insertion into packages for retail sale.

According to the instant invention, this problem has been resolved through the use of a novel crank-actuated tucker blade which operates reliably at the speeds above 500 units/min.—and also provides the important facility of being able to "cull". Even in the best operated machines, there appears, from time-to-time, a defective diaper, which has to be excluded from the packaging operation. It is impossible to do this manually at the speeds indicated—and current folding devices do not provide for deactivation for culling and re-engagement for folding without great complexity and cost, or speed limitations or both. Through the practice of the invention, the acceptable diapers are transversely folded from a position of advance in a horizontal path for delivery into a vertical path for packaging. The defective diapers are culled by displacing the folding mechanism so that the impaired diapers proceed along the original path and thereby do not get to the packaging station—now at speeds beyond 500 units/min. without interruption of the continuous orbiting motion of the folding device thus providing higher speed culling, a lower cost device not requiring disengaging of the drive means and higher reliability.

The novel folding mechanism makes use of an orbiting blade which passes through the horizontal path of advancement of the stream of diapers. Although orbiting mechanisms per se are not novel—see, for example, co-owned U.S. Pat. No. 3,256,012—orbiting mechanisms have not been used for the purposes of this invention nor have they provided the advantages attendant to the instant invention. One significant advantage of the instant invention is the ability to cull defective diapers at high speed by displacing the orbiting tucker blade to a position of non-engagement with the stream of diapers. Displacement mechanisms also are not novel but again lack the structure and operation of the instant invention, compare, for example, co-owned U.S. Pat. No. 3,740,049.

Other advantages and objects of the invention may be seen in the details of the ensuing specification.

The invention is described in conjunction with the accompanying drawing in which—

DETAILED DESCRIPTION

Figure 1:
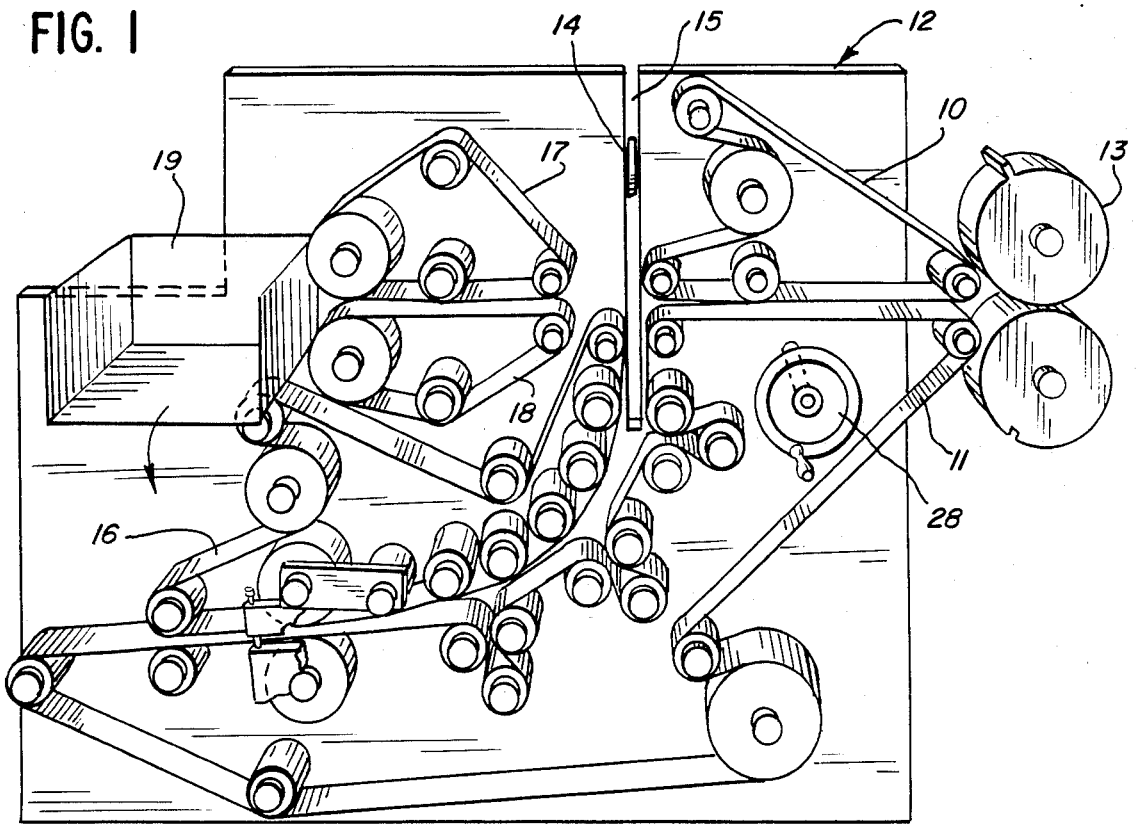
FIG. 1 is a fragmentary perspective view of a diaper machine embodying teachings of this invention.

Referring to the drawing, and FIG. 1 in particular, a perspective view of the operating side of the machine is seen.

Operation Generally

Diapers, not shown, move from right to left in FIG. 1 under the influence of an upper belt 10, a lower belt 11, both of which are suitably mounted on the machine frame generally designated 12. Individual diapers are severed from a continuous web by means of a cutoff device 13 shown at the extreme right of FIG. 1.

Figure 2:
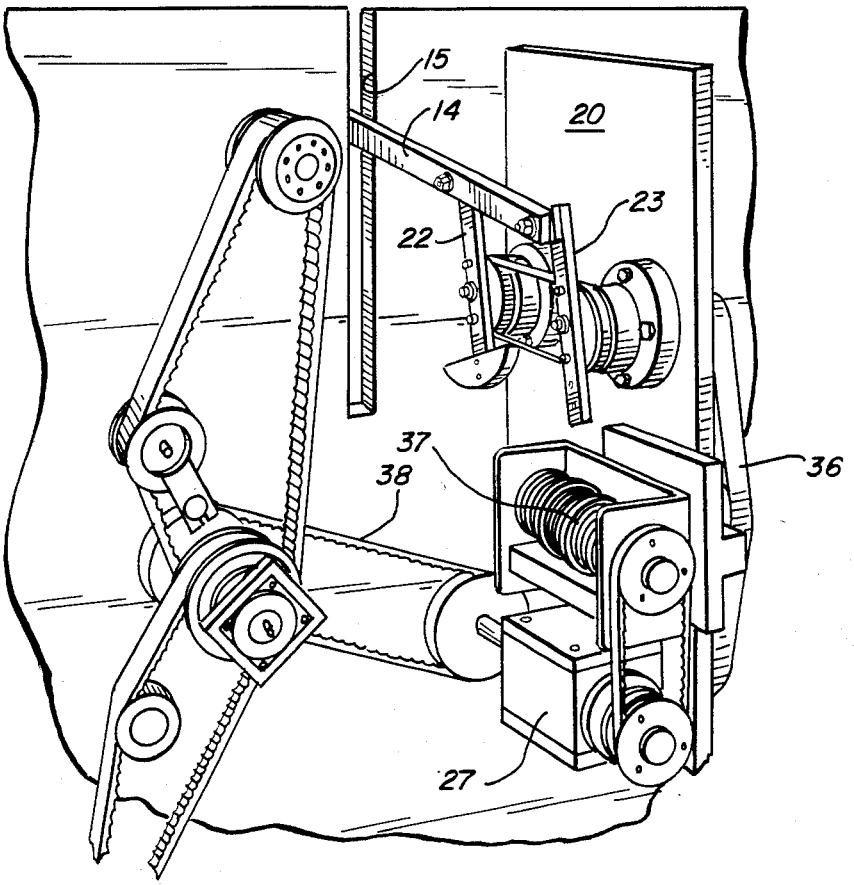
FIG. 2 is another fragmentary perspective view taken from the opposite side of the machine.

When the diapers are of acceptable quality, each individual diaper in the sequence is folded on itself by the downward movement of the tucker blade 14 which moves up and down in a vertical slot 15—compare the showing in the upper central portion of FIG. 2 which is taken from the drive side of the machine. The acceptable diapers are then conveyed along a generally arcuate path defined by the lower belt system 11 and a second upper belt system 16. Thereafter, the diapers are delivered in sequence to packaging equipment.

When, however, a defective diaper is present in the stream being advanced by the upper and lower belt systems 10 and 11, the invention provides for a different operation of the tucker blade 14 so as to permit the defective diaper to continue moving to the left in FIG. 1 and thereby come under the control of a second upper belt system 17 and a lower belt system 18 for delivering the defective diapers to a cull box 19.

The mechanism for controlling the movement of the blade tucker 14 will now be described.

Blade Tucker Control Mechanism

Figure 3:
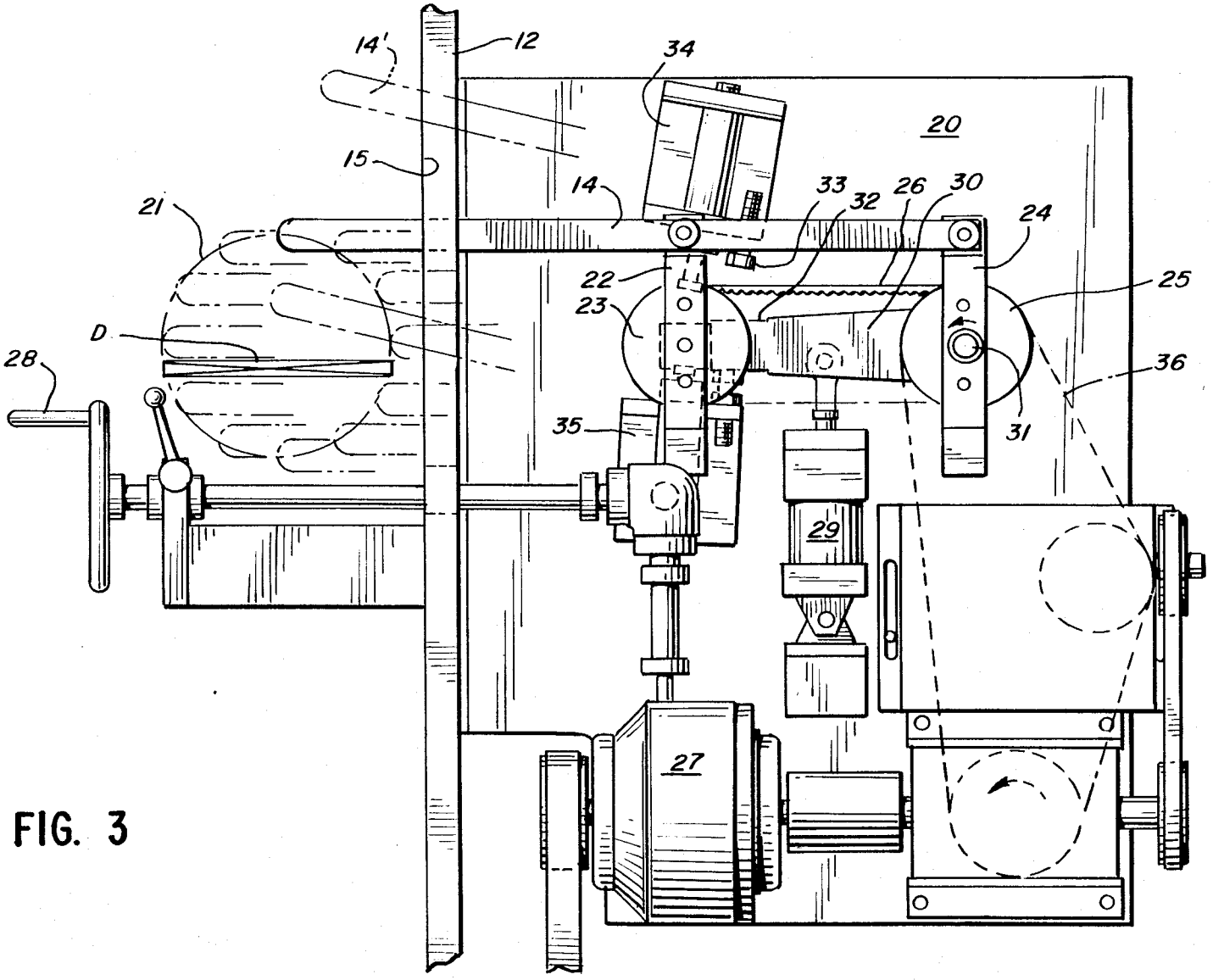
FIG. 3 is a side elevational view of the inventive tucker blade and its associated actuating mechanism.
Figure 4:
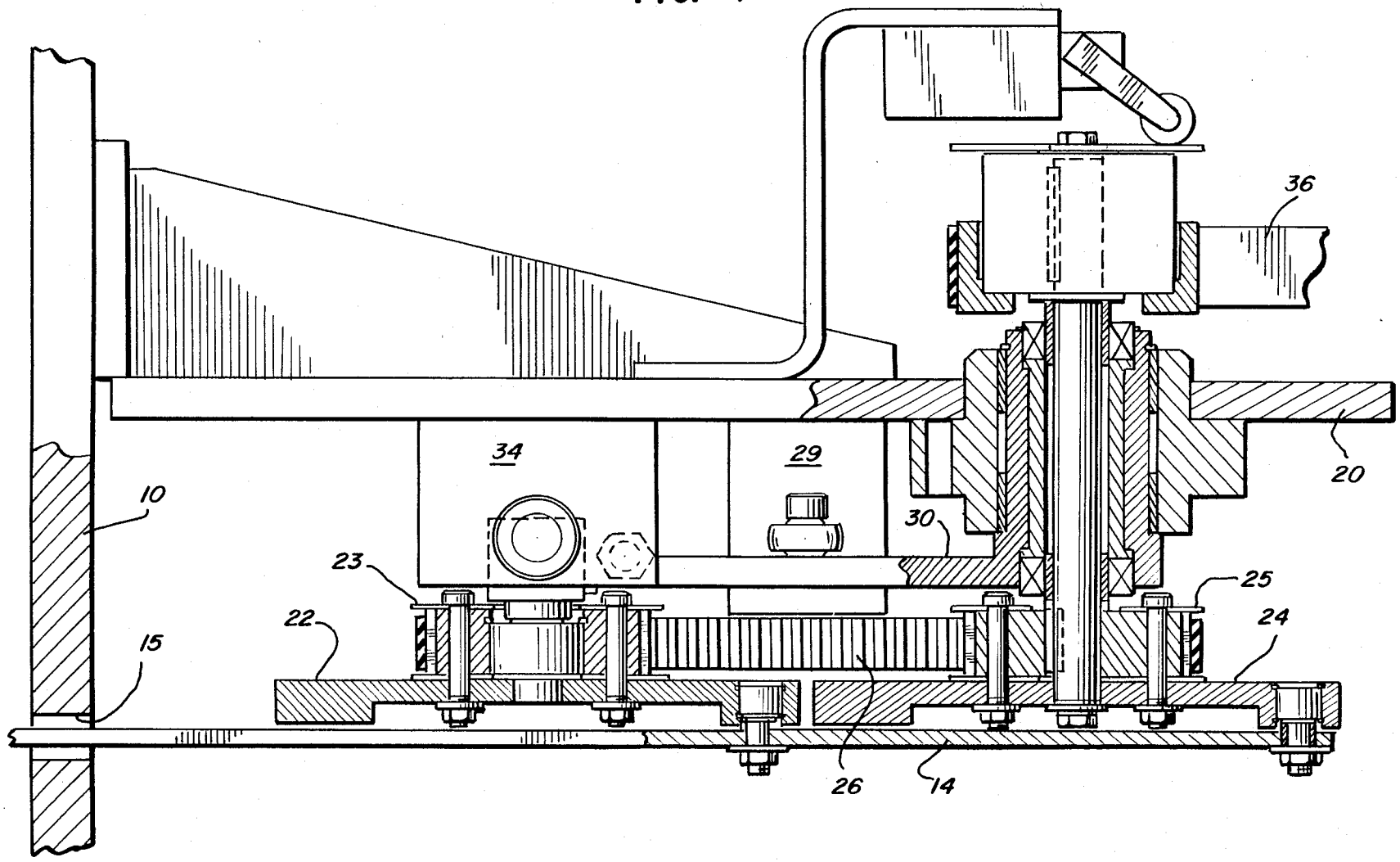
FIG. 4 is a plan view of a portion of FIG. 3.

FIG. 3 is a side elevation of the blade tucker and associated mechanism and includes a frame portion 20 mounted at a right angle to the main frame portion 12 of the diaper manufacturing machine.

On the left and in phantom is shown the circular orbit 21 of the blade 14 which extends through the slot 15 in the frame 12. When the blade is fully extended to the left and at maximum downward velocity, it contacts the precut diaper D to transversely fold it and force it into the nip of the belt pair 10, 11 mounted directly below the diaper. Thereafter the folded diaper is conducted to a packaging station as illustrated in FIG. 1.

The blade 14 is pivotally mounted on a first arm 22 which is attached to and rotated with an idling timing belt pulley 23 and a second arm 24 attached to and rotatable with a driven timing belt pulley 25. The interconnecting timing belt is designated 26.

Shown at the lower left in FIG. 3 is a phasing box 27 which constitutes a means to adjustably phase the blade motion with the diaper so that the blade at its maximum velocity (maximum extension to the left) contacts the diaper halfway along its length. This is under the operator's control by virtue of the handwheel 28—see also FIG. 1.

To cull an imperfect or defective diaper, the tucker blade moves out of the way, i.e., the orbit is displaced. This is indicated schematically in the drawing by the uppermost position of the blade 14 being designated 14'. This deactivation comes about by activating the cull lift cylinder 29 which pivots arm 30 about shaft 31 until the machined flat 32 contacts stop screw 33. To advantageously stabilize the bar or arm 30 in its rapid motion—300–400 blade strokes per minute—shock absorbers 34 and 35 are provided at both the top and bottom of the stroke.

The driven timing belt pulley 25 is journalled in the frame 20 and also pivotally mounted coaxial therewith is the bar 30. The driven timing belt pulley 25 is driven by another timing belt 36 and the entire crank mechanism including the pulleys and bar is able to pivot upwardly (advantageously about 13°) while still rotating, and when in the up position, the displaced orbit (schematically represented by 14') is above the diaper sufficiently to allow the diaper to pass therebeyond for removal.

Omitted from the showing in FIG. 2 for clarity of presentation is the orbit shifting mechanism including the air cylinder 29, arm 30 and shock absorbers 34, 35. However, seen in FIG. 2 is a timing switch 37 which is used to phase the electrical impulse triggering the air cylinder 29 which, in turn, displaces the orbit of the tucker blade 14. Still referring to FIG. 2, 38 designates a belt traveling between two pulleys, one of which is connected to the hand wheel shaft 28 and the other to the phasing unit 27.

While in the foregoing specification a detailed description of an embodiment of the invention has been set down for the purpose of illustration, many variations in the details hereingiven may be made by those skilled in the art without departing from the spirit and scope of the invention.

We claim:

1. A method for operating a diaper-producing machine comprising advancing a series of unfolded diapers along a horizontal path, orbiting a tucker blade for each diaper through said horizontal path to fold the diaper and deliver the now-folded diaper to a vertical path, and displacing the orbit of said tucker blade upwardly out of said horizontal path whenever a defective diaper appears in said series.

2. The method of claim 1 in which said tucker blade orbits in the range of about 500 to about 600 times per minute.

3. The method of claim 2 in which said tucker blade is cushioned when the orbit thereof is displaced.

4. The method of claim 1 in which the phase of said tucker blade in its orbit is adjusted during tucker blade movement to impact diapers at predetermined fold lines.

5. The method of claim 1 in which said tucker blade during said folding orbit is always positioned in the same attitude relative to said horizontal path.

6. Apparatus useful in the operation of a diaperproducing machine comprising means for advancing a series of unfolded diapers along a horizontal path, means for orbiting a tucker blade for each diaper through said horizontal path to fold the diaper and deliver the now-folded diaper into a vertical path, and means for displacing the orbit of said tucker blade upwardly out of said horizontal path whenever a defective diaper appears in said series.

7. The apparatus of claim 6 in which a first frame portion is provided to support said advancing means, a second frame portion operably associated with said first frame portion, said orbiting means including a crank mechanism mounted on said second frame portion.

8. The apparatus of claim 7 in which said crank mechanism includes a pair of horizontally spaced-apart pulley means interconnected by timing belt means, each pulley means having an arm fixed thereto, said tucker blade being relatively elongated and pivotally connected to each of said arms.

9. The apparatus of claim 8 in which said crank mechanism includes a bar interconnecting said pulley means, and fluid cylinder and piston rod means interconnected between said second frame portion and said bar for displacing the tucker blade orbit.

10. The apparatus of claim 9 in which said second frame portion is equipped with shock absorber means for cooperation with said arm to stabilize said crank mechanism in desired position.

11. The apparatus of claim 6 in which phase adjustment means is operably associated with said orbiting means for adjusting the position of said tucker blade to impact diapers at predetermined fold lines.

12. Apparatus for transversely folding diapers comprising a frame, means on said frame for advancing diapers ':n sequence through a folding zone, said frame in said zone being equipped with means for removing folded diapers sequentially, a first pulley pivotally mounted on said frame and aligned with said zone, a bar pivotally mounted on said frame co-axially with said first pulley, a second pulley pivotally mounted on said bar a spaced distance from said first pulley, belt means coupling said first and second pulleys, each pulley having a bar affixed thereto in parallel relation, a tucker blade pivotally connected to said bars and projecting toward said advancing means, means for rotating said first pulley to orbit said tucker blade, and cylinder and piston rod means interconnected between said frame and bar for displacing said orbit.

13. The apparatus of claim 12 in which said frame is equipped with a pair of shock absorbers flanking said bar for stabilizing the same upon actuation of said unit.

14. The apparatus of claim 12 in which said rotating means has orbit phase adjustment means operably associated therewith to vary the position of impact with the diapers being advanced.

* * * * *